United States Patent [19]

Lagneau

[11] Patent Number: 4,504,177

[45] Date of Patent: Mar. 12, 1985

[54] EMPTYING APPARATUS FOR A SILO

[76] Inventor: Jean H. Lagneau, 1, Grande Rue, Tremblay-les-Villages, Chateauneuf-en-Thymerais, 28170, France

[21] Appl. No.: 457,649

[22] Filed: Jan. 13, 1983

[30] Foreign Application Priority Data

Jan. 15, 1982 [FR] France ..... 82 00575
Jun. 18, 1982 [FR] France ..... 82 10650

[51] Int. Cl.[3] ..... B65G 53/02

[52] U.S. Cl. ..... 406/86; 406/88; 406/136

[58] Field of Search ..... 406/86, 88–90, 406/136–138

[56] References Cited

U.S. PATENT DOCUMENTS 2,492,585 12/1949 Kohout ..... 406/89 X
2,882,097 4/1959 Hamren ..... 406/88

FOREIGN PATENT DOCUMENTS 661670 3/1964 Italy ..... 406/90
734036 7/1955 United Kingdom ..... 406/90
654511 3/1979 U.S.S.R. ..... 406/137

*Primary Examiner*—Jeffrey V. Nase
*Assistant Examiner*—Daniel R. Edelbrock
*Attorney, Agent, or Firm*—Sandler and Greenblum

[57] ABSTRACT

An emptying apparatus for removing the last contents of a silo includes an elevated floor supported by at least two support members above the bottom of the silo. The support members form at least one ventilating channel under the elevated floor. The elevated floor has a flat section for supporting at least two upper sheets, and at least one rib member disposed above the elevated floor and defining at least one emptying channel for emptying the contents of the silo. The flat section of the elevated floor has at least one transverse slit which connects the ventilating channel with the emptying channel. One of the upper sheets is disposed above the transverse slit and the flat section and overlaps another upper sheet to form a slit between them. The extent of overlap of the overlapping sheet is greater than the slide ramp of the silo product located to the right of the slit between the two sheets, such that the product particle cannot easily back up in the slit and drop through the transverse slit in the flat section to the ventilating channel below. An emptying spout connects the emptying channel to an evacuation duct which is disposed in a pressurized air distribution channel. The distribution channel is pressurized by a fan. Each of the upper sheets is of substantially trapezoidal shape and has along its wide base a downward lip and along its narrow base an upward lip, each lip being provided with oblong orifices. The total cross-sectional area of the oblong orifices is approximately one half the total cross-sectional area of the corresponding ventilating channel. The total cross-sectional area of the ventilating channel is approximately one half that of the ventilating exit. A plurality of ventilating channels and emptying channels can be provided.

7 Claims, 11 Drawing Figures

Fig. 5
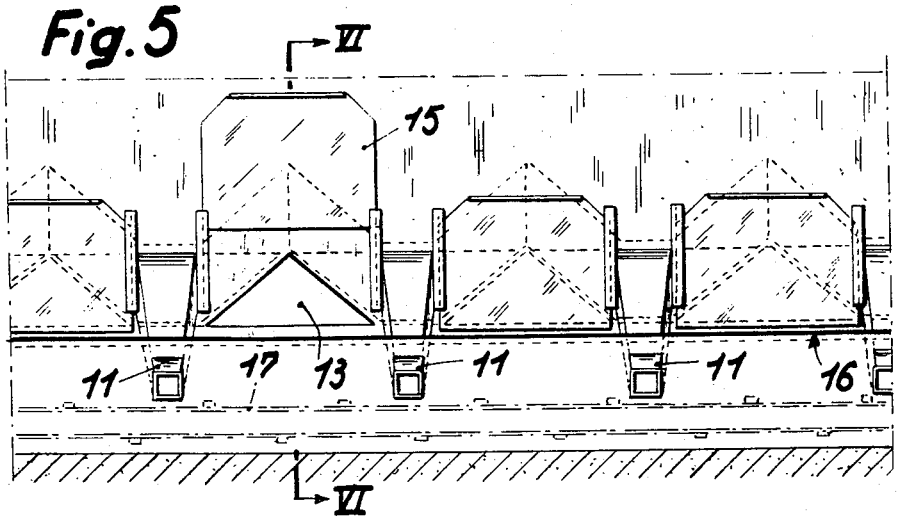
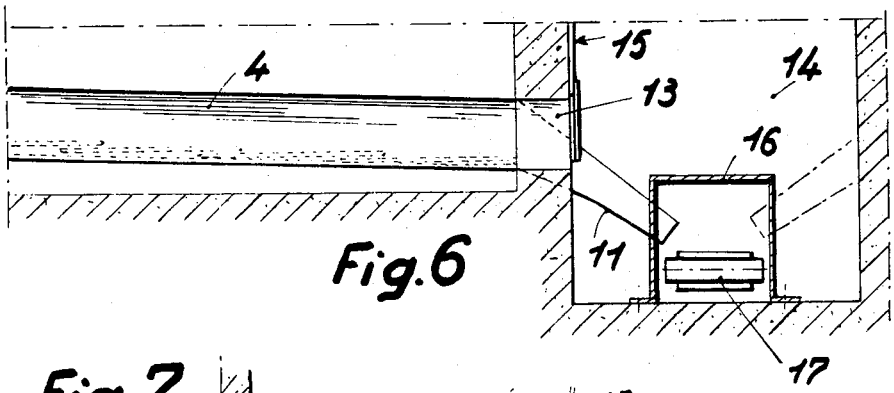
Fig. 6
Fig. 7
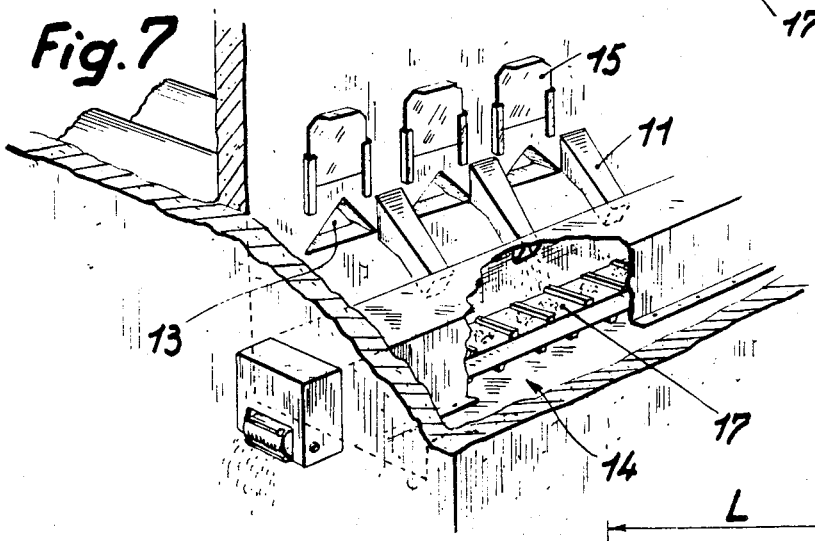
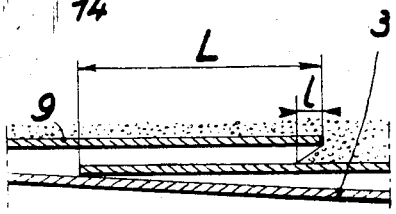
Fig. 8

EMPTYING APPARATUS FOR A SILO

TECHNICAL FIELD OF THE INVENTION

The present invention relates to an improvement in emptying apparatus for flat-bottomed silos for holding grains or the like.

BACKGROUND OF THE INVENTION

In flat-bottomed silos for storing grains or the like, emptying the last portion of the product in the silo presents a problem. As long as the remaining volume is great, gravity operates to empty the silo. But, toward the end of the emptying process, when there is very little product left in the silo, the remaining products from a sloping pile which will not empty from the silo merely through the action of gravity. The remaining volume is not necessarily negligible, as in some silos it can reach several tons which will not slide out of the silo.

To accomplish complete emptying, apparatus for sliding and forcing this remaining mass towards the exit opening of the silo must be provided.

Conventional systems provide for injection of pressurized air under the silo floor.

According to a first known system, the silo floor has openings formed by slits in a metal sheet which forms the silo floor. The metal on one side of the slit is moved to create outlets in the metal floor. However, this process is disadvantageous in that it cannot be used for large silos, e.g., where the length of the silo sides or the diameter of the silo is in the range of a few dozen meters, because in such cases, substantial energy is necessary to move the metal on one side of the slit.

According to a second known system, casings are provided alternating between flat sections and hollow ribs at the bottom of the silo. The casings have air outlets on each of their sides, and each hollow rib forms a ventilating duct. This known system, however, is disadvantageous in that grains tend to rub against the floor sections located between adjacent ribs, requiring much energy to overcome this friction. Furthermore, this system is disadvantageous in that the airstream at the outlets flows obliquely in relation to the forward feeding direction of the grains, thus resulting in inefficient use of energy.

In order to reduce energy loss, it is possible to force the air through some ventilation ducts and to cause emptying by intermittent operations. In conventional systems, emptying is achieved by forcing air through two ventilation ducts defining an emptying channel. However, in such systems, most of the air escapes via the sides of the empty adjacent emptying channel.

BRIEF DESCRIPTION OF THE INVENTION

The present invention relates to silos of the type having an elevated floor held above the bottom of the silo, with hollow ribs arranged under the floor to form ventillation channels separated by flat, support sections. Air penetrates the emptying channel defined by the floor and two adjacent ribs through transverse slits on the bottom of the emptying channel. An upper sheet is placed above each transverse slit and partially extends over an underlying sheet which is disposed downstream, the two sheets forming a slit between them. The overlap length is greater than the product sliding ramp to the right of the slit between the sheets, thus preventing the product from dropping through the transverse slit into the ventilation channel below the floor.

The sheets are preferably substantially horizontal, but the silo floor preferably has a slope having a value which is a function of the sheet length and the height of the slit located between the sheets. In practice, this slope is very minimal and is less than 4 percent.

Such systems enable intermittent emptying of the silo without requiring substantial power input.

Moreover, in order to avoid penetration of grain or other products into the ventilation channels, the transverse slits in the bottom of the elevated floor should be approximately 1.5 millimeters wide.

The air speed at the outlets of the slits between sheets should not be too great, or grains will be moved either very little or not at all. For a given output, the air speed at the outlets depends on the air pressure in the ventilation channel, and thus it depends on the relationship between the total cross-section of the transverse slits and the cross-section of the ventilation channel. The smaller the ratio between the total cross-section of the slits to the cross-section of the channel, the greater will be the air speed at the slit outlets. The air speed at the slit outlets is preferably approximately 14 meters per second.

Two solutions have been devised to achieve the result of a desirable air speed at the slit outlets.

First, the section of each ventilation channel can be reduced, thus requiring an increase in the number of required ventilation channels. This solution is generally unsatisfactory because it complicates the operation of the apparatus and increases the time required for emptying the silo.

Second, the number of transverse slits can be increased in order to increase the total sectional area of the slits. This solution is generally unsatisfactory because it leads to an increase in the number of sheets required, thus resulting in increased costs without yielding sufficiently improved results.

The present invention involves a third solution which includes considerably augmenting the section of each transverse slit. To achieve this, sheets are provided which have ends folded back to form lips on each end of the sheet. The lips project downwardly at the front end of the sheet and upwardly at the back end. Each lip has a plurality of vertical oblong orifices, having widths preferably in the range of 15 millimeters.

In this manner, the total cross-section of the air outlets is augmented.

According to the present invention, an emptying apparatus for a silo includes an elevated floor, at least two support members for supporting the elevated floor above the bottom of the silo, the support members forming at least one ventilation channel under the elevated floor. The elevated floor includes a flat section for supporting at least two sheets, and includes at least one rib member disposed above the elevated floor, the rib member defining at least one emptying channel for emptying the contents of the silo. The flat section has at least one transverse slit connecting the ventilation channel with the emptying channel. One of the sheets is disposed above the at least one transverse slit and overlaps the other sheet to form a slit between them. The overlap length between the sheets is greater than the slide ramp of the product located to the right of the slit in order to prevent the product from droping through the transverse slit into the ventilation channel below the elevated floor. The flat section of the elevated floor can be sloping. The at least two sheets are preferably substantially horizontal. The ventilation channel can be defined by (a) the pair of support members which extend from the bottom of the silo to the elevated floor; (b) the flat section; and (c) a rib member. The ventilation channel can include an orifice opening into a pressurized air distribution channel. A shutter can be provided which is adapted for closing the orifice. The distribution channel can be pressurized by a fan.

The apparatus can include an emptying spout attached between the emptying channel and an evacuation duct which is disposed in the pressurized air distribution channel and which extends outside at least one end of the distribution channel, the emptying spout opening in an airtight manner into the distribution channel. The evacuation duct can include a conveyor. The silo bottom can be sloped. A third support member can be provided wherein the third support member and one of the other support members support the flat section of the elevated floor, and the third support member and the other of the support members support the ribs. The rib is preferably substantially in the shape of an inverted V-section. The third support member has an orifice with a cross-sectional area greater than the cross-sectional area of the ventilation channel.

Each of the sheets is preferably of substantially trapezoidal shape and has along its wide base a downward lip and along its narrow base an upward lip, each lip having oblong orifices. The width of the oblong orifices are less than the diameter of the grains or other particles stored in the silo, preferably approximately 1.5 millimeters. The total section of the oblong orifices is preferably approximately one half the section of the corresponding ventilation channel. The total section of the ventilation channel is preferably approximately one half the total section of the ventilation exit.

The system can include a pressurized air distribution channel with an evacuated duct disposed therein, with the ventilation and emptying channels crossing through the silo wall to extend into the distribution channel, and with the emptying channel being coupled in an airtight manner into the evacuated duct. The emptying channel, which crosses through the silo wall, is provided with a cover.

The apparatus can include a pressurized air distribution channel, with an evacuated duct disposed therein, with the ventilation and emptying channels both extending to the wall of the evacuated duct, and with the emptying channel opening into the evacuated duct in an airtight manner.

The elevated floor can include a plurality of flat sections and a plurality of ribs, wherein the flat sections and the ribs alternate to form the elevated floor, and wherein a plurality of pairs of flat members support the elevated floor and form a plurality of ventilation channels under the floor.

BRIEF DESCRIPTION OF THE DRAWINGS

Embodiments of the present invention are shown by way of example in the accompanying drawings, wherein:

FIG. 5 is a sectional view of the section along line V—V shown in FIG. 1;

FIG. 6 is a sectional view of the section along line VI—VI of FIG. 5;

FIG. 7 is a perspective, partial view, illustrating the side emptying apparatus;

FIG. 8 is an enlarged view of detail A shown in FIG. 2;

DETAILED DESCRIPTION OF THE INVENTION

Figure 1:
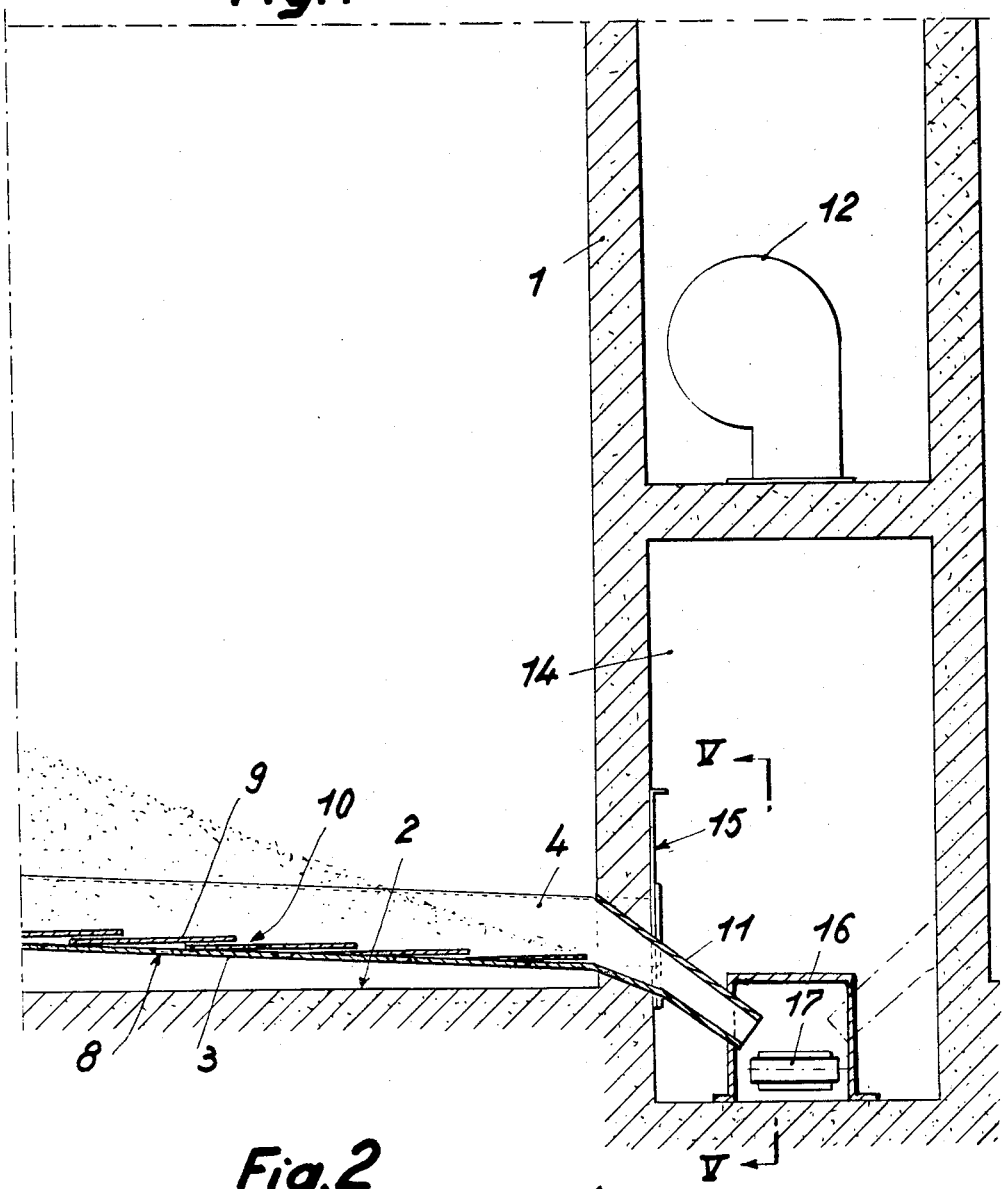
FIG. 1 is a vertical sectional view of a first embodiment of the silo emptying apparatus of the present invention.
Figure 3:
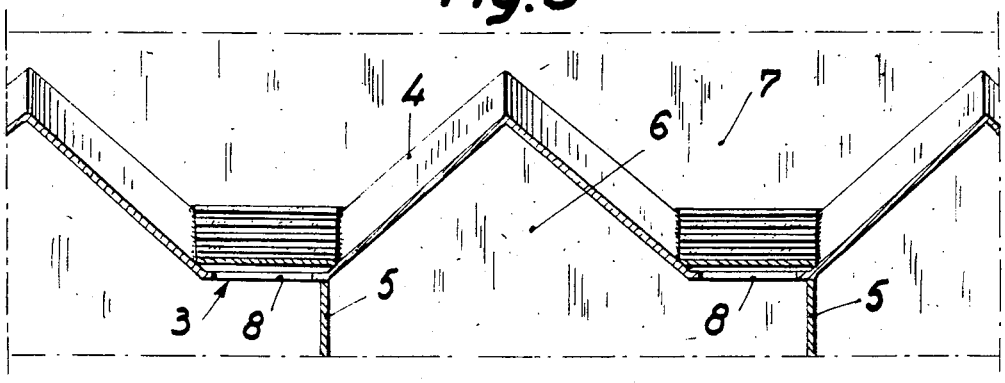
FIG. 3 is a sectional view along section III—III of FIG. 2.
Figure 4:
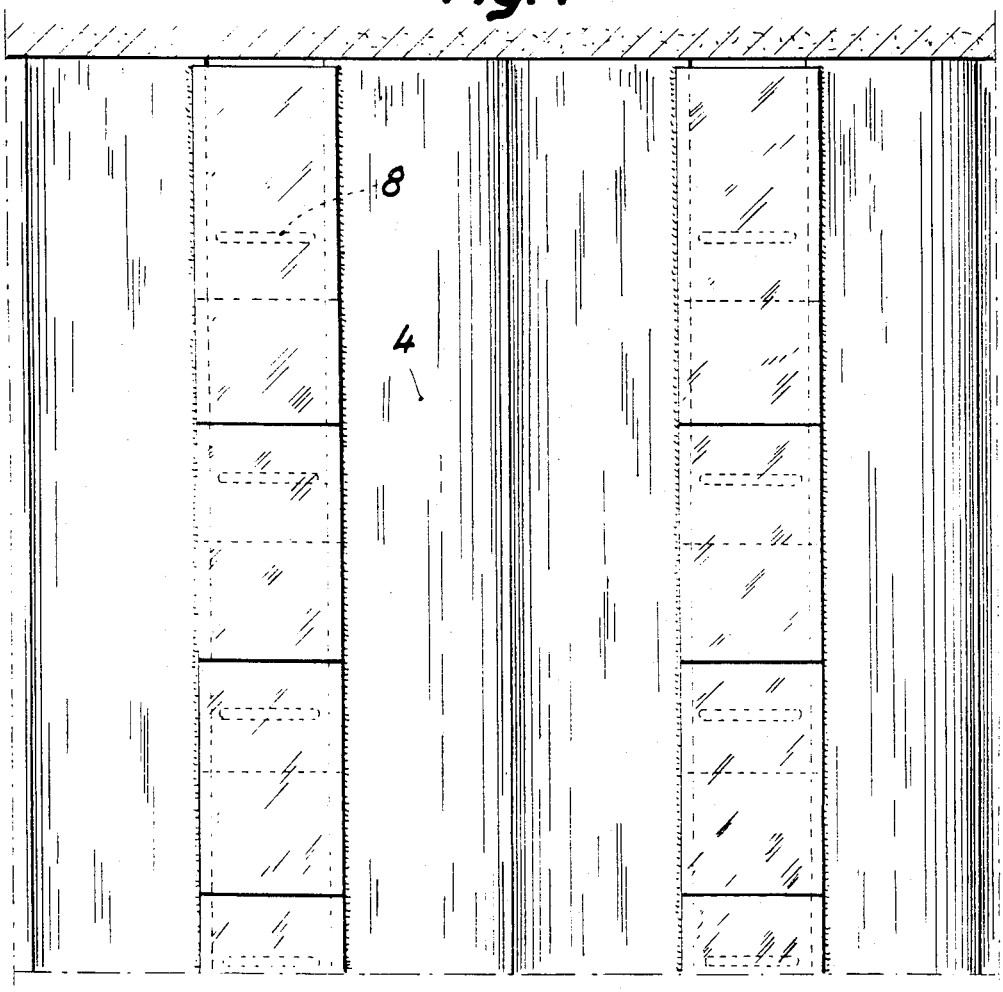
FIG. 4 is a top view of the apparatus shown at FIG. 3.

FIG. 1 illustrates one embodiment of the invention, showing silo 1 of rectangular cross-section, and having a flat bottom 2. An emptying apparatus, including a metal floor having alternating flat section 3 and ribs 4 are supported on bottom 2. Ribs 4 are formed in the shape of an upside down V-section, as shown in FIG. 3. Support members 5 extend from bottom 2 to the metal floor, and serve to separate ventilating channels 6 from one another. Each flat section 3 forms on its oblique sides ribs 4 adjacent to emptying channel 7. Each flat section 3 has a transverse slit 8. Above each slit 8 is a sheet 9 which is substantially horizontal and which is welded to the metal floor at flat section 3 at its upstream end and at its side, while the downstream end 9*a* is free, in cantilever beam fashion, and partially extends over the next, downstream, underlying sheet 9. Two adjacent sheets 9 form a slit 10. The length L of overlap is greater than the length l of the product sliding ramp which is located to the right of slit 10, as shown in FIG. 8; this relationship is provided so that the particles of the product stored in the silo cannot easily back up through slit 10 and fall through transverse slit 8 into ventilating channel 6.

Each emptying channel 7 is coupled with a spout 11 which extends out of silo 1.

Figure 2:
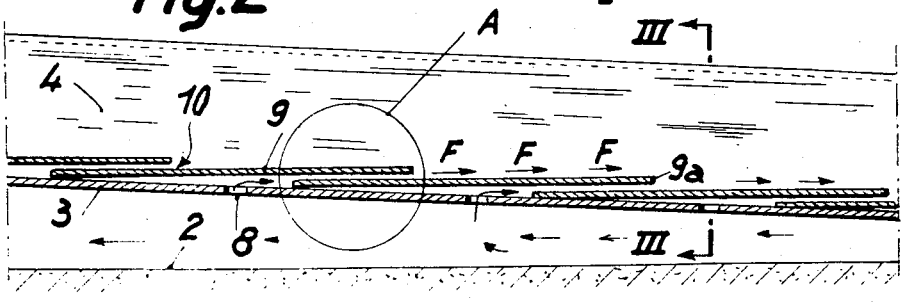
FIG. 2 is an enlarged partial view of the lower portion of the silo emptying apparatus of the present invention.

In operation, when air is forced through a channel 6, it passes through slits 8 and 10, exiting through emptying channel 7, while flowing parallel to sheets 9, as shown by arrows F in FIG. 2. In this way, i.e., because the forced air flows parallel to sheets 9, all of the energy of the air is used to push the remaining product toward exit spout 11. In other words, the air does not flow obliquely with respect to the direction that the silo products are desired to be pushed, thus energy is not lost.

In addition, frictional losses are almost zero because grains or other particles located on sheet 9, which are pushed toward an underlying sheet, do not rub against the underlying sheet because of the air current which exists between the two sheets which insulate the underlying sheet; thus, the grains or other particles float above the metal floor formed of alternating flat sections 3 and ribs 4.

A single fan 12, shown in FIG. 1, can be used to assist in simultaneous emptying of two silos. This is accomplished by ventilation channel 6 which opens through orifices 13 in the silo wall into canal 14, which is pressurized through operation of fan 12.

Orifices 13 can be closed by shutter 15. Spouts 11 open in an airtight fashion into evacuation duct 16 which extends out of one end of canal 14 and which includes a handling component, such as conveyor 17. Each spout 11 can include a conventional closing apparatus not shown in the figures.

Figure 9:
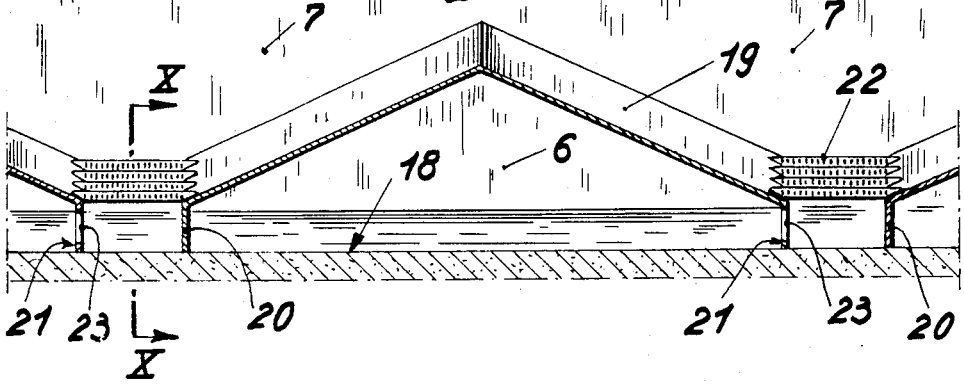
FIG. 9 is a partial view of a second embodiment of the silo emptying apparatus of the present invention showing a section across a transverse vertical plane extending to the ribs.
Figure 10:
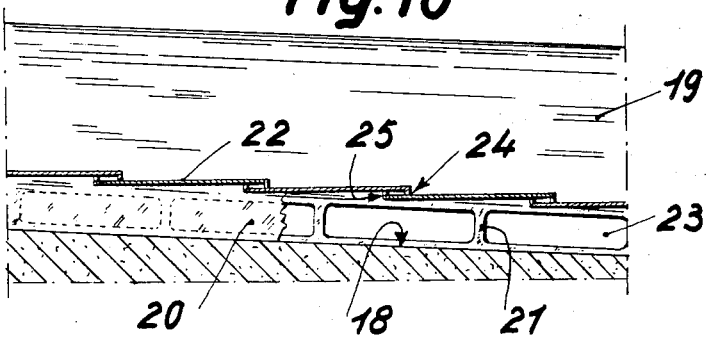
FIG. 10 is a sectional view along the section X—X shown in FIG. 9.
Figure 11:
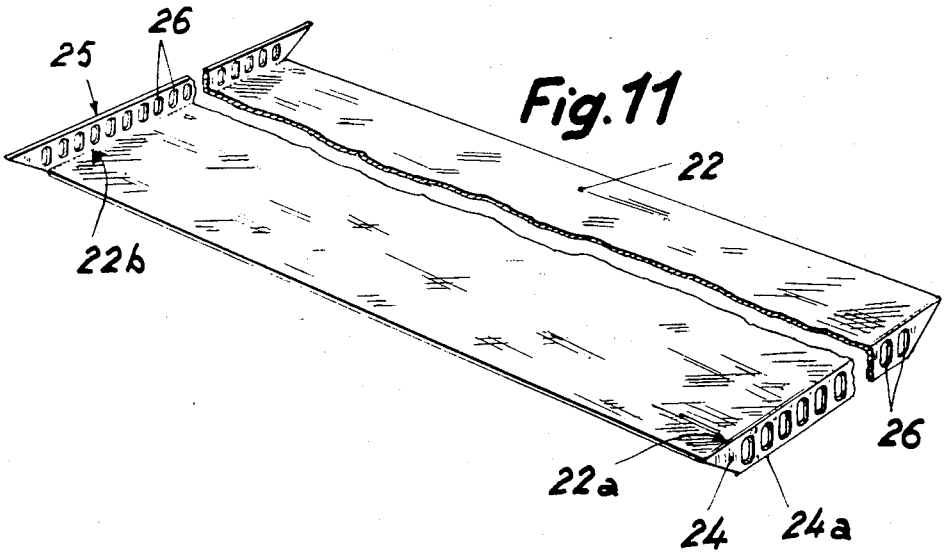
FIG. 11 is an enlarged perspective view of a sheet according to the embodiment shown in FIG. 9.

According to a second embodiment shown in FIGS. 9–11, bottom 18 of silo 1 is flat and sloped at approximately 5 degrees. Ribs 19, formed in an upside down V-section, rest on bottom 18 on vertical wings 20 and 21. Each ventilating channel 6 is defined by (1) bottom 18; (2) wing 20; (3) rib 19; (4) sheets 22 which join two ribs 19; and (5) wing 21 of adjacent rib 19.

Wing 21 of each rib 19 has orifices 23 which, taken together, have a total section which is greater than the total section of ventilating channel 6.

Each sheet 22 is substantially trapezoidal in shape and has along its long base **22*a*, a lip 24 curved downwardly, and along its small base 22*b*, a lip 25 curved upwardly. On each curved lip, oblong orifices 26, having a width less than the diameter of the grains or other particles which are to be stored in the silo, are provided. In practice, the width of each oblong orifice 26** is approximately 1.5 millimeters.

Lower end **24*a* of each lip 24 rests on the underlying sheet 9 as shown in FIG. 10. Accordingly, for each ventilating channel 6, the air outlets have a total section which is approximately one half of the section of the ventilating channel 6**; thus, an air outlet speed of approximately 14 meters per second is achieved. Such speeds do not raise the air outlet flow appreciably, and are thus able to move grains or other particles.

However, at the initiation of emptying of residual grains, most of the air exits through the orifices of the lowest sheets which support the least amount of grain. When the air outlet speed at oblong orifices 26 is too high, the amount of grain movement still is not satisfactory.

Accordingly, the present invention provides for the total exit section of each sheet to decrease from the highest sheet to the lowest sheet.

According to another aspect of the present invention, the section of each ventilating channel 6 is about half the section of the covering of the ventilating exit which feeds it.

It should be noted that the assembly formed by rib 19 and its wings 20 and 21 can be made of a corrugated sheet tunnel, either circular or elliptical in shape.

It should further be noted that the total section of oblong orifices 26 on rear section 25 of each sheet 9 is preferably greater than the total section of oblong orifices 26 on front section 24.

Finally, in an embodiment where pressurized air distribution canal 14 is not built into silo 1, ventilation channels 6 and emptying channels 7 go through the silo wall and extend to canal 14; emptying channels 7 are coupled in an airtight fashion to evacuation duct 16, which is arranged as a rehandling conveyor by disposing spout 11 such that grains or other products discharged from silo 1 will fall onto conveyor 17. Sections of emptying channel 7 which extend outside silo 1 are preferably covered. Such arrangement applies particularly to round silos.

Alternatively, in embodiments where rehandling conveyor 17 is not housed in distribution canal 14, ventilating channels 6 and emptying channel 7 extend to the wall of conveyor 17, but only emptying channels 7 open into conveyor 17.

From the foregoing description, one skilled in the art can easily ascertain the essential characteristics of the present invention and, without departing from the spirit and scope thereof, can make various changes and modifications of the invention to adapt it to various usages and conditions.

I claim:

1. An emptying apparatus for a silo with a bottom, said apparatus comprising:

(a) a floor located above said silo bottom, said floor comprising a plurality of hollow ribs, adjacent hollow ribs being connected by a plurality of overlapping sheets, adjacent overlapping sheets being separated by individual slits, a plurality of ventilating channels located directly above the bottom of the silo, each of said ventilating channels being defined by said silo bottom, a first wing extending downwardly from a respective rib to the bottom of said silo, one of said ribs, and a second wing extending downwardly from an adjacent rib, each of said ventilating channels opening into a single canal which is pressurized by a blower, a shutter being associated with each of said channels and comprising means for selectively obturating an orifice located at one end of each said ventilating channel, each of said ribs having an upper portion which forms, in combination with a set of said overlapping sheets, an emptying channel which opens into an evacuation duct located within said canal, each of said emptying channels being fluidically connected to said evacuation duct by a spout.

2. An emptying apparatus for a silo in accordance with claim 1 wherein each of said sheets has a generally trapezoidal configuration and along its longest side comprises a portion which is curved downwardly, and along its shortest side, a portion which is curved upwardly, each of said curved portions having oblong orifices therein, the width of each of said orifices being less than the diameter of grain located within said silo, each of said sheets having a lower edge, the lower edge of each of said sheets resting on an adjacent sheet positioned beneath it.

3. An emptying apparatus for a silo in accordance with claim 2 wherein the total section of said oblong orifices is approximately equal to half of the section of a single corresponding ventilating channel.

4. An emptying apparatus for a silo in accordance with claim 1 wherein each of said ribs is supported by two wings, one of said wings having orifices with a total section greater than the section of one of said ventilating channels.

5. An emptying apparatus for a silo in accordance with claim 1 wherein said ventilating channel is pressurized by a fan.

6. A silo emtpying apparatus in accordance with claim 1, said evacuation duct including a conveyor.

7. A silo emptying apparatus in accordance with claim 1 wherein each of said ventilating channels is substantially in the shape of an inverted V-configuration.

* * * * *